US005832645A

United States Patent [19]

Wells

[11] Patent Number: 5,832,645

[45] Date of Patent: Nov. 10, 1998

[54] BACKLIT FRAME FOR CIGARETTE LIGHTER

[76] Inventor: Brett W. Wells, 2029 Swan Dr., Costa Mesa, Calif. 92626

[21] Appl. No.: 815,598

[22] Filed: Mar. 12, 1997

[51] Int. Cl.[6] ..... G09F 19/00

[52] U.S. Cl. ..... 40/716; 362/183; 362/198; 40/593

[58] Field of Search ..... 40/593, 716; 362/812, 362/183, 61, 83.3, 198, 191

[56] References Cited

U.S. PATENT DOCUMENTS

| | | | |
|---|---|---|---|
| 1,459,083 | 6/1923 | Becker | 40/555 |
| 5,313,724 | 5/1994 | Warner . | |
| 5,408,771 | 4/1995 | Manrubia . | |
| 5,412,887 | 5/1995 | Layne . | |
| 5,533,241 | 7/1996 | McConnell . | |

FOREIGN PATENT DOCUMENTS

| | | | |
|---|---|---|---|
| 2228130 | 8/1990 | United Kingdom | 40/593 |
| 8703354 | 6/1987 | WIPO | 362/183 |
| 9323839 | 11/1993 | WIPO | 40/1 |

*Primary Examiner*—Cassandra H. Davis
*Attorney, Agent, or Firm*—Terrance L. Siemens

[57] ABSTRACT

An automobile accessory comprising an illuminated picture frame which is insertable into a receptacle of a cigarette lighter of a motor vehicle for power and for mounting. The picture frame has a plug assembly which is compatible with the receptacle of the cigarette lighter with respect to interfit within the receptacle. The plug assembly also has electrodes located to connect to power from the receptacle. The plug assembly therefore both supports the picture frame and provides electrical power for lighting. A suitable lamp is provided behind the picture or slide for back lighting the same. The picture frame has electrical circuitry connecting the light to the electrodes. A switch is provided for extinguishing the lamp. The switch may be located on the visible exterior of the picture frame or alternatively, on the plug assembly.

5 Claims, 2 Drawing Sheets

BACKLIT FRAME FOR CIGARETTE LIGHTER

BACKGROUND OF THE INVENTION

1. Field of the Invention

The present invention relates to an illuminated picture frame, and more particularly, to an illuminated picture frame adapted for insertion into the cigarette lighter of a motor vehicle for power and for support.

2. Description of the Prior Art

Frames and cases for displaying photographs and other artwork have become more complicated over time. Among features developed to adorn the artwork is illumination. Display cases and frames have acquired lamps for bringing out detail which might go unnoticed in locations having inadequate ambient illumination.

Illuminated cases and frames are seen in U.S. Pat. Nos. 5,313,724, issued to Sheila J. Warner on May 24, 1994, 5,408,771, issued to Bob Manrubia on Apr. 25, 1995, and 5,412,887, issued to James R. Layne on May 9, 1995. In each example, plural lamps are arranged around the periphery of the frame or case. Circuitry brings power from a power cord or a battery. By contrast, the present invention has a single light disposed to shine forwardly from a generally centered location behind the display casing, and power is obtained from a generally cylindrical plug assembly disposed perpendicularly with respect to the front surface of the display casing.

It has become common practice to modify and adorn motor vehicles with all kinds of accessories, both functional and aesthetic. A number of functional accessories, notably tools and appliances, have been designed to connect to the electrical receptacle originally provided and intended for operating a cigarette lighter. No prior art picture frame known to the present inventor utilizes a plug assembly compatible with a receptacle for a cigarette lighter, the plug assembly being rigidly fixed to a display case or frame.

None of the above inventions and patents, taken either singly or in combination, is seen to describe the instant invention as claimed.

SUMMARY OF THE INVENTION

The present invention provides an accessory for a motor vehicle, comprising a small, back lit picture frame which is supported by and supplied with electrical power by the receptacle of a cigarette lighter of the motor vehicle. The picture frame is suitable for displaying a picture or slide while illuminating the same from the rear, or backlighting the picture or slide. This accessory personalizes the interior of the motor vehicle and provides an avenue for articulating affiliation, affection, and pride relating to the subject of the displayed picture or slide.

The novel picture frame has a plug assembly which essentially duplicates the configuration of the cigarette lighter, thereby being compatible with the receptacle in terms of interfitting therewith. The plug also has electrodes arranged similarly to those of a cigarette lighter, so that insertion of the plug assembly assures that power from the battery of the motor vehicle will be available immediately.

The plug assembly is rigidly attached to the picture frame via a swivel joint. Therefore, insertion of the plug assembly into the receptacle provides adequate support for the picture frame, as well as assuring an electrical supply. Because some cigarette receptacles are connected to power only when the ignition switch has been moved to an operative position while others are constantly energized, a switch is provided for conserving battery power when the motor vehicle is not in use, and for extinguishing the light at times when it may prove distracting or is otherwise objectionable.

In an alternative embodiment, the plug assembly is semi-rigidly attached to the picture frame. This signifies that the plug assembly is connected to the picture frame by a member which is bendable by hand, but is sufficiently rigid to maintain its configuration after bending. The advantage of semi-rigid attachment is that the displayed object may be inclined so as to be visible from a desired direction. This feature may be required to render artwork visible in some motor vehicles wherein a receptacle for the cigarette lighter is located towards the floor or otherwise defeats direct viewing of the displayed object.

Accordingly, it is a principal object of the invention to provide a back lit picture frame suitable for prolonged mounting in a motor vehicle.

It is another object of the invention to provide electrical power for the novel picture frame from the motor vehicle.

It is a further object of the invention to support the novel picture frame at a location within the interior of the cabin of the motor vehicle.

Still another object of the invention is to connect the picture frame to power and to support the picture frame by the same structure of the picture frame.

An additional object of the invention is to enable switching of the illumination of the novel picture frame, for conserving battery power and to extinguish lighting when not desired.

It is again an object of the invention to personalize the interior of a motor vehicle.

Yet a further object of the invention is to enable the displayed object to be inclined while mounted.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
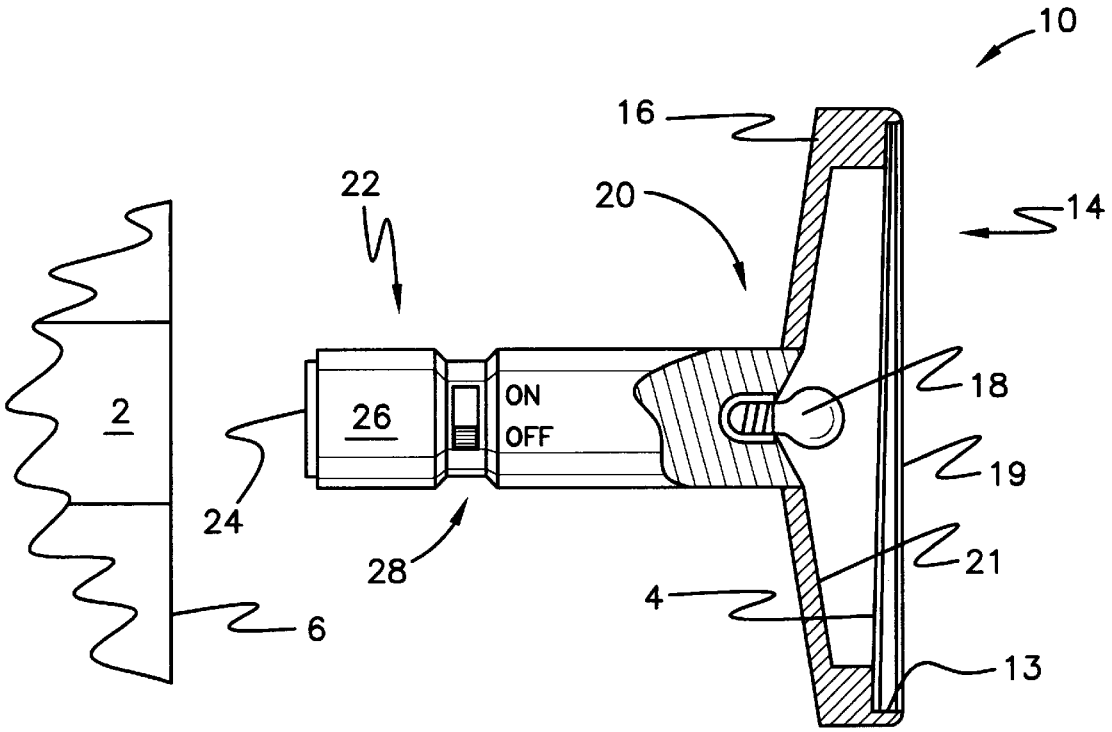
FIG 1 is an environmental, side elevational view of the invention, shown partially in cross section, with associated components of a motor vehicle shown diagrammatically.

Turning now to FIG. 1 of the drawings, novel illuminated picture frame 10 is shown in a position from which it may be inserted and mounted in a conventional power receptacle 2 of a cigarette lighter of a motor vehicle (not shown in its entirety). Picture frame 10 includes a peripheral frame 12 for surrounding and supporting a planar object 4, such as a photograph or slide, at the periphery of the planar object. Peripheral frame 12 is dimensioned and configured to cooperate with rectangular object 4, including stepped configuration, as indicated at 13, for receiving and retaining object 4.

Peripheral frame 12 may be said to have a viewing side 14, this being that side which would be visible when picture frame 10 is mounted in power receptacle 2, and a mounting side 16, which is that side facing receptacle 2 and the surface 6 of the dashboard or other member of the cabin of the motor vehicle in which receptacle 2 is mounted. Optionally, a transparent front panel 19 is removably fixed to peripheral frame 12 at viewing side 14 of peripheral frame 12, for covering and protecting object 4.

An electrically powered light source, such as lamp 18, is disposed in a suitable socket 20, and is located on mounting side 16 of peripheral frame 12. Socket 20 may be mounted in a plug assembly 22, which is dimensioned and configured to cooperate with power receptacle 2. Power receptacle 2 is generally standardized in dimensions and configuration throughout the automotive industry in the United States, with the result that dimensions and configuration of cooperating plugs are widely known. Also standard is the location of electrodes (not separately shown) in conventional receptacles.

Peripheral frame 12 has a frustoconical or inclined surface 21 for reflecting light forwardly. Surface 21 assures more even projection of light over object 4.

Plug assembly has electrodes 24, 26 which are in rearwardly accessible locations corresponding to those of a cigarette lighting element (not shown) which would be compatible with receptacle 2. Compatibility, as employed herein, signifies that electrodes 24, 26 will contact corresponding electrodes (not shown) provided in receptacle 2, for conducting electrical current.

Plug assembly is rigidly attached to peripheral frame 12 at mounting side 16 thereof. This characteristic assures that illuminated picture frame 10 may be supported by insertion of plug assembly 22 into receptacle 2, as well as being afforded an electrical supply thereby. In the embodiment depicted in FIG. 1, a switch (not shown in its entirety) for disconnecting lamp 18 from power from electrodes 24, 26 is disposed within plug assembly 22. A switch operator 28 is disposed upon an accessible surface of plug assembly 22.

Figure 2:
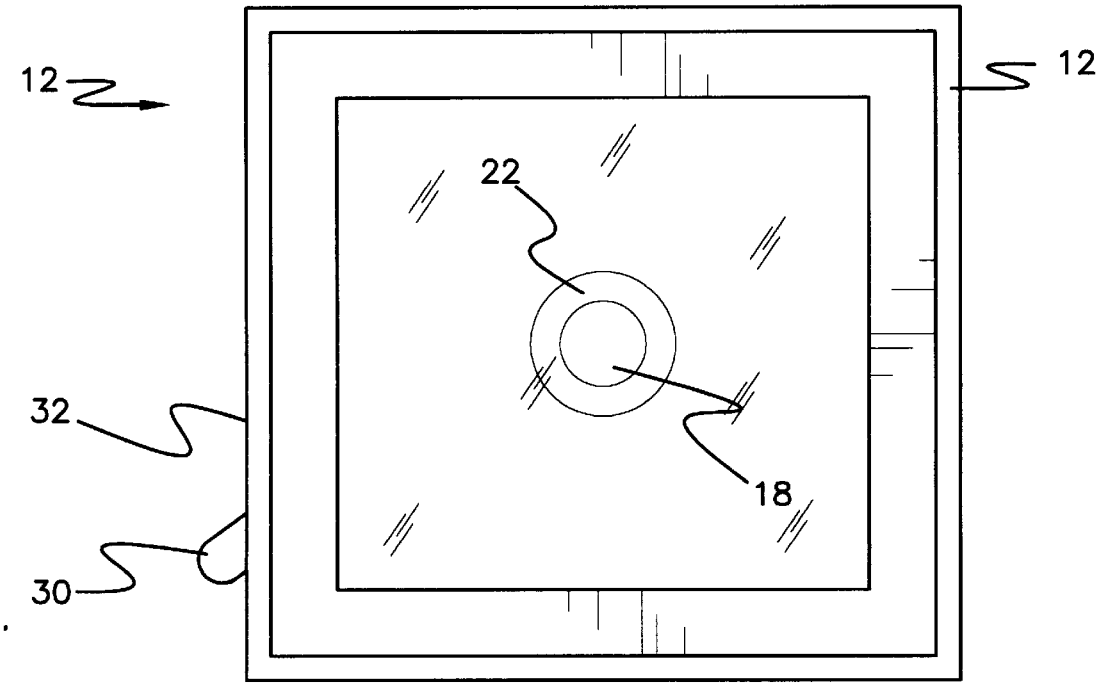
FIG. 2 is a front elevational view of the invention.

FIG. 2 illustrates an alternative embodiment wherein a switch operator 30 is located on a surface 32 of peripheral frame 12 accessible from viewing side 14. This embodiment enables lamp 18 to be extinguished without removing illuminated picture frame 10 from receptacle 2.

Figure 3:
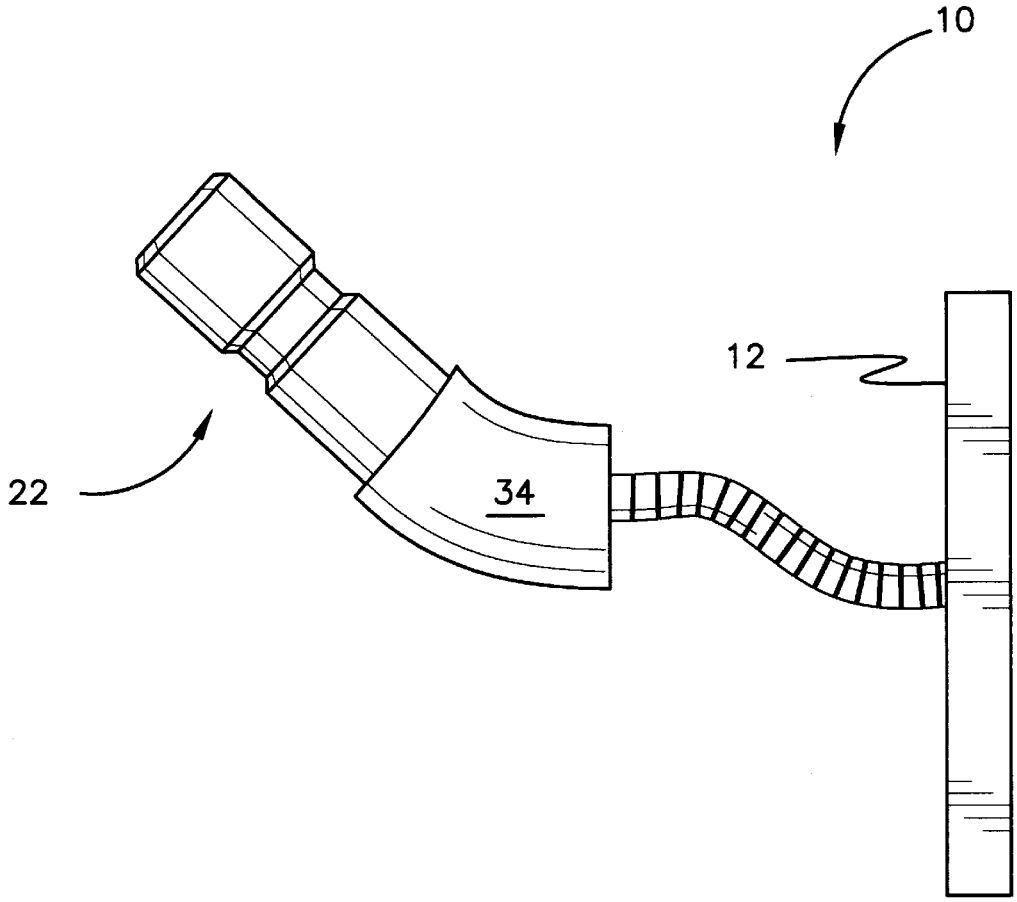
FIG. 3 is a side elevational view of an alternative embodiment of the invention.

FIG. 3 illustrates an alternative embodiment of the invention, wherein plug assembly 22 is connected to peripheral frame by a semi-rigid member 36. Member 36 is semi-rigid in that it is readily bendable by hand, but will hold its configuration after bending. Member 36 may be formed from a spirally wound metal strip, or may comprise any material embodying semi-rigid properties. Member 36 is optionally provided to enable the user to incline peripheral frame and therefore artwork contained therein as desired. Thus it can be seen that the peripheral frame 12 may be tilted in respect to the plug assembly 22, which is fixed in place after being inserted into the receptacle (indicated at 2 in FIG. 1) of the motor vehicle cigarette lighter. This is a useful attribute since receptacle 2 in some motor vehicles is located such that it would be desirable to incline the artwork to promote advantageous viewing. An optional collar 34 of diameter increased over that of plug assembly 22 enables adjustment of angular relationship between plug assembly 22 and peripheral frame 12.

Figure 4:
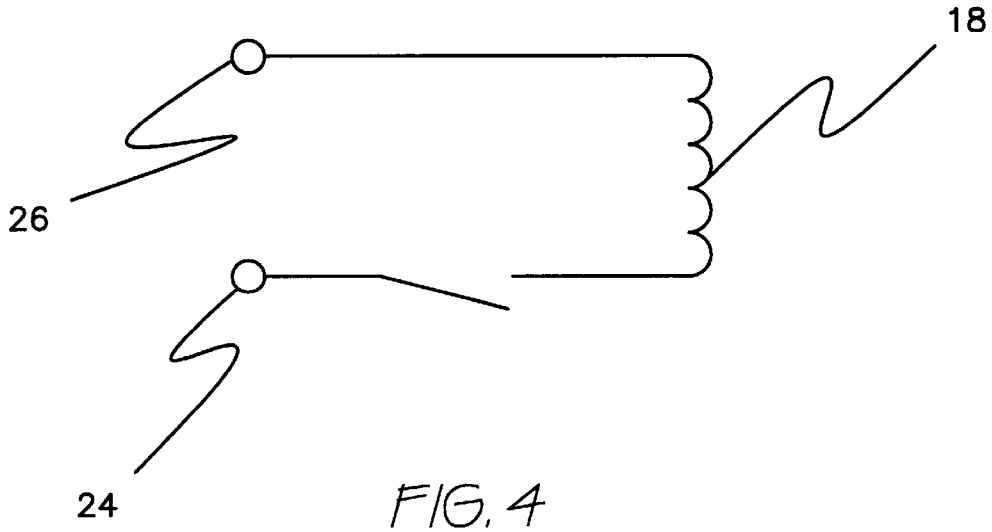
FIG. 4 is an electrical schematic of the circuit of the invention.

FIG. 4 is a simplified electrical schematic illustrating circuitry conducting electrical power from electrodes 24, 26 to lamp 18, and a suitable location of the switch of either FIG. 1 or FIG. 2 within this circuitry.

The present invention is susceptible to modifications and variations which may be introduced by those of skill in the art. For example, lamp 18 may be replaced by any suitable electrical light, including light emitting diodes, among others. The location of switch operator 28 and its associated switch may be varied to suit. Peripheral frame may be modified to enable insertion of object 4 from different directions, and to include structure for more securely retaining object 4. Lamp 18 may be provided with a reflector or diffuser for modifying light dispersion. Lamp 18 may be varied in location, and additional lighting may be provided. Plural switches may be provided.

It is to be understood that the present invention is not limited to the embodiments described above, but encompasses any and all embodiments within the scope of the following claims.

I claims:

1. An illuminated picture frame for mounting in a conventional power receptacle of a cigarette lighter of a motor vehicle, comprising:

a peripheral frame for surrounding and supporting a planar display at the periphery of said display, said peripheral frame including a viewing side and a mounting side;

an electrically powered light source located between said viewing side and said mounting side of said peripheral frame, said electrically powered light adapted to direct light towards said viewing side and through said planar display within said peripheral frame;

a plug assembly adapted to cooperate with the conventional motor vehicle cigarette lighter power receptacle, said plug assembly including electrodes to conduct power from the power receptacle to said electrically powered light source, said plug assembly being located proximate said mounting side of said peripheral frame; and peripheral frame adjustment member located between said plug assembly and said peripheral frame, said peripheral frame adjustment member having an elongated semi-ridge bendable member adapted to retain it's configuration after bending to allow a user to tilt said peripheral frame, and thus direct the light directed towards said viewing side of said peripheral frame to a desired angle, in respect to said plug assembly, when said plug assembly is inserted in the conventional cigarette lighter receptacle.

2. The illuminated picture frame according to claim 1, including a transparent panel located proximate said viewing side of said peripheral frame, for covering and protecting said planar display.

3. The illuminated panel according to claim 1, further including a switch for disconnecting said electronically powered light source from the power provided by the receptacle and conducted through said electrodes.

4. The illuminated picture frame according to claim 3, where said switch is located on said peripheral frame.

5. The illuminated picture frame according to claim 3, said switch being located on said plug assembly.

* * * * *